US006240692B1

(12) United States Patent
Yost et al.

(10) Patent No.: US 6,240,692 B1
(45) Date of Patent: Jun. 5, 2001

(54) CONCRETE FORM ASSEMBLY

(76) Inventors: Louis L. Yost; William R. Yost, both of 16365 Falls Rd., Monkton, MD (US) 21111

( * ) Notice: Subject to any disclaimer, the term of this patent is extended or adjusted under 35 U.S.C. 154(b) by 0 days.

(21) Appl. No.: 09/580,247

(22) Filed: May 26, 2000

(51) Int. Cl.[7] ..... E04C 1/41
(52) U.S. Cl. ..... 52/426; 52/565; 52/563
(58) Field of Search ..... 52/426, 565, 563, 52/699, 713, 714, 309.12, 309.11

(56) References Cited

U.S. PATENT DOCUMENTS 5,570,552 * 11/1996 Nehring ..... 52/426
5,809,728 * 9/1998 Tremeling ..... 52/426
5,845,488 * 12/1998 Potvin ..... 52/426 X
5,887,401 * 3/1999 Moore, Jr. ..... 52/426

FOREIGN PATENT DOCUMENTS

541742 * 10/1955 (BE) ..... 52/426
175441 * 2/1945 (SE) ..... 52/426
411591 * 2/1945 (IT) ..... 52/426

* cited by examiner

*Primary Examiner*—Richard Chilcot
(74) *Attorney, Agent, or Firm*—Leonard Bloom

(57) ABSTRACT

A concrete assembly form having a plurality of panels adjoined to one another to form opposing walls. A plurality of studs are encased in each panel. Each stud has a truss structure for increased strength and has a plurality of cylinders extending from the inner face of each panel. The opposing walls are connected with a plurality of bridges, each having collars on the ends in which are seated the cylinders from the panels. U-shaped rods are connected between the cylinders. A hold-down clip connects the bridges between vertically oriented panels. A method of preparing the assembly is disclosed.

40 Claims, 19 Drawing Sheets

CONCRETE FORM ASSEMBLY

FIELD OF THE INVENTION

The present invention is directed to a concrete form assembly of panels which are spaced apart to form walls into which concrete is poured for construction purposes. More particularly, the present invention is directed to means to economically and efficiently assemble and strengthen the forms.

BACKGROUND OF THE INVENTION

It is known that insulated panels may be joined together to form walls which are interconnected with ties so that two parallel walls are formed into which concrete may be poured for construction purposes.

U.S. Pat. No. 4,229,920 to Lount illustrates the general arrangement of studs embedded in modular plastic blocks, the studs having respective inwardly-protruding portions which engage cooperating bridges to retain the blocks in position during the pouring of the concrete U.S. Pat. No. 4,730,422 to Young discloses the wall-ties (bridges) have T-shaped ends that slide into corresponding recesses in the blocks to form the studs. The studs are not integrally molded within the blocks. The furring strips are screwed into the T-shaped ends and the drywall or the like is secured to the furring strips.

Horobin, In U.S. Pat. No. 4,894,969, discloses a pair of removable inserts consisting of an upper insert and a lower insert. These inserts are received into, and supported by, transverse strut members.

Mensen, in U.S. Pat. No. 5,390,459, discloses bridging members which extend entirely through the foam blocks and terminate in end plates, respectively, which abut against the outside surface of the expanded polystyrene blocks or panels.

U.S. Pat. No. 5,566,518 to Martin et al disclose a form tie which engages the sidewalls of the concrete form to maintain the walls in place during pouring and curing of the concrete. Each tie includes laterally-extending brackets positioned at the ends of a web. This web is a flat plate which spans a pair of hangers extending from the strut. At the end of each support strut is a vertical sidewall-support assembly having vertically-extending flanges.

Tremelling, in U.S. Pat. Nos. 5,701,710 and 5,809,728, discloses a tie member and having bearing plates, intermediate stabilizing plates and strips, respectively. The bearing plates are embedded in the plastic foam member, and the intermediate stabilizing plates abut the inner surfaces of the foam members.

Vaughan et al, in U.S. Pat. Nos. 5,709,060 and 5,845,449, disclose specific designs of a form tie which have a lattice of members.

Grutsch, in U.S. Pat. No. 5,735,093, discloses a backing plate adjacent to the outer face of each panel. The backing plate is connected to a channel-shaped "socket" by connectors. The two confronting sockets are connected together by an inside tie having two strips received in the respective sockets.

In U.S. Pat. No. 5,819,489, McKinney discloses a web made of a mesh and disposed between a pair of "elongated members", respectively. The web allows the concrete to flow therethrough.

This technique has been used commercially All of these patents and commercial products use different ways and structures to maintain spacing between the walls.

There is a need for further improvements to enhance the structural strength of the assembly form, to simplify assembly and to reduce costs.

BRIEF SUMMARY OF THE INVENTION

It is an object of the present invention to provide a concrete form assembly which can be connected rapidly and with a minimum of training and which provides improved strength.

It is a further object to provide a concrete form assembly which is economical to produce and to assemble.

It is another object of the present invention to provide a high degree of flexibility for the architect, mechanical engineer, contractor, developer and/or the building owner; that is, using standardized readily-available components, the degree of required strength may be selected consonant with cost parameters for any particular job.

In accordance with the teaching of the present invention, there is disclosed a concrete form assembly for construction of structures. The assembly has at least a first and a second rectangular insulation panel. Each panel has respectively a top, a bottom, a first side, an opposite second side, an inner face and an outer face. A plurality of studs is provided, each stud being a molded plastic strip being formed from a plurality of adjoining trapezoidal members with gussets. Each stud has a first end and an opposite second end. A plurality of spaced-apart cylinders are formed on each stud between the first end and the second end thereof Each cylinder is connected to the stud by a connector member. Each cylinder has a respective axial hole formed therein. The studs are encased in the respective inner faces of the at least two panels between the tops and the bottoms thereof, wherein the connector members and the cylinders extend outwardly from the respective inner faces of the panels. The studs are parallel to one another and spaced apart by a uniform selected distance. A plurality of bridges is provided, each bridge having a body with a length, a first end and an opposite second end. A collar is formed respectively on the first end and the second end of each bridge. Each collar is a hollow cylinder having a slot formed opposite from the body, wherein a selected number of bridges may be disposed between the first panel and the second panel with selected cylinders on the respective panels being frictionally seated in the collars to connect the inner face of the first panel to the inner face of the second panel. The respective slots in the collars straddle the respective connector members. In this manner, the first panel is connected to the second panel by the plurality of bridges and the panels are spaced apart by a distance determined by the length of the bridge such that concrete may be introduced into the space between the inner faces of the first panel and the second panel.

In further accordance with the teachings of the present invention there is disclosed a concrete form assembly for construction of a structure having at least two rectangular insulation panels, each having a top, a bottom, two opposite sides and an inner face. Means are provided for interlocking a plurality of panels in their respective tops, bottoms and sides to form a first wall and a second opposite wall. A plurality of studs are encased in each panel between the respective tops and bottoms thereof, each stud having a plurality of spaced-apart cylinders formed thereon wherein the respective cylinders extend outwardly from the inner face of each panel. A plurality of bridges are provided, each bridge having opposite ends. A collar is formed on the opposite ends of each bridge. A selected number of bridges are disposed perpendicularly between the first wall and the second wall wherein the respective cylinders are seated in the respective collars to connect and space-apart the inner faces of the at least two panels of the opposite walls such that concrete may be introduced between the at least two panels.

Additionally in accordance with the teachings of the present invention, there is disclosed a concrete form assembly for construction of a structure having at least two rectangular insulation panels. Each panel has an inner face, the respective inner faces being opposed to one another. The inner face of each panel has a plurality of spaced-apart cylinders extending outwardly therefrom, each cylinder having an axial hole formed therein. An inverted U-shaped rod has a base with a desired length and two legs at right angles to the base. One leg is received in the axial hole in a selected cylinder on one of the panels and the other leg is received in the axial hole in a selected cylinder on the opposite panel, thereby separating the panels and providing support to the assembly.

In still further accordance with the teachings of the present invention there is disclosed a concrete form assembly for construction of a surface having a plurality of rectangular insulation panels. Each panel has an inner face, a top and a bottom. Means are provided for interlocking the tops and bottoms of at least two panels wherein at least one upper panel is disposed over at least one lower panel to form respectively a first wall and an opposite second wall. A plurality of connecting means are formed in the inner faces of each panel. A plurality of bridges are provided, each having a first end and an opposite second end. Means are provided for connecting the first end of each bridge to a selected connecting means on a selected panel in the first wall. Means are provided for connecting the second end of each bridge to an opposite selected panel in the second wall. In this manner, a plurality of upper bridges are disposed between the respective upper panels and a plurality of lower bridges are disposed between respective lower panels in the first wall and the second wall. Means are provided for connecting the upper bridges with the lower bridges to increase the strength of the concrete form assembly.

There is further disclosed a building structure, wherein a pair of spaced-apart panels form a mold for pouring a concrete wall therebetween, and wherein the panels have respective studs embedded therein. The studs have respective inwardly-disposed projections. Wire rod bridges are provided having a snap-fit connection to respective pairs of inwardly-disposed projections on the studs, thereby connecting the studs together, and thereby maintaining the panels in their spaced-apart disposition during the pouring of the concrete.

Additionally, there is disclosed a building structure, wherein a pair of spaced-apart panels form a mold for the pouring of concrete therebetween, and wherein a plurality of respective pairs of spaced-apart panels are arranged horizontally and vertically with respect to each other to form a wall. A plurality of wire rod bridges cooperate with respective pairs of inwardly-projecting studs embedded in the panels, thereby maintaining the panels in their spaced-apart disposition during the pouring of the concrete. A plurality of hold-down clips connect at least some of the wire rod bridges on respective adjacent pairs of panels, thereby keeping the adjacent pairs of panels together for improved stability in the subsequent pouring of the concrete. The wire rod bridges and the hold-down clips provide a reinforcement in the concrete for increased wall strength.

In another aspect, there is disclosed a method of preparing a form assembly for construction of a concrete wall. At least a pair of spaced-apart opposed panels are provided. Each panel has a plurality of spaced-apart studs embedded therein. Each stud has a plurality of inwardly-disposed projections, each projection having a snap-fit connection formed therein. A plurality of wire rod bridges are provided. Each bridge has opposite ends. The wire rod bridges are disposed between the opposed panels. The respective ends of each bridge are connected to a respective snap-fit connection on a respective projection. The opposite panels are maintained in the spaced-apart disposition and the wire rods provide reinforcement for the concrete.

In yet another aspect, there is disclosed a method of preparing a form assembly for construction of a structure. At least two rectangular insulation panels are provided, each having a top, a bottom, two opposite sides and an inner face. A plurality of panels are interlocked on their respective tops, bottoms and sides thereby forming a first wall and a second wall. A plurality of studs are encased in each panel between the respective tops and bottoms, each stud having a first end and an opposite second end. A plurality of spaced-apart cylinders are formed on each stud between the first end and the second end thereof. Each cylinder has an axial hole formed therein. The cylinders extend outwardly from the respective inner faces of the panels. A plurality of bridges are provided, each bridge having a length, a first end and a second end. A collar is formed respectively on the first end and the second end of each bridge. Each collar is a hollow cylinder. A selected number of bridges are disposed between the first panel and the second panel such that selected cylinders on the respective panels are frictionally seated in the collars on the bridges to connect the inner face of the first panel with the inner face of the second panel. The panels are spaced apart by a distance determined by the length of the bridge.

These and other objects of the present invention will become apparent from a reading of the following specification taken in conjunction with the enclosed drawings.

DESCRIPTION OF PREFERRED EMBODIMENTS

Figure 1:
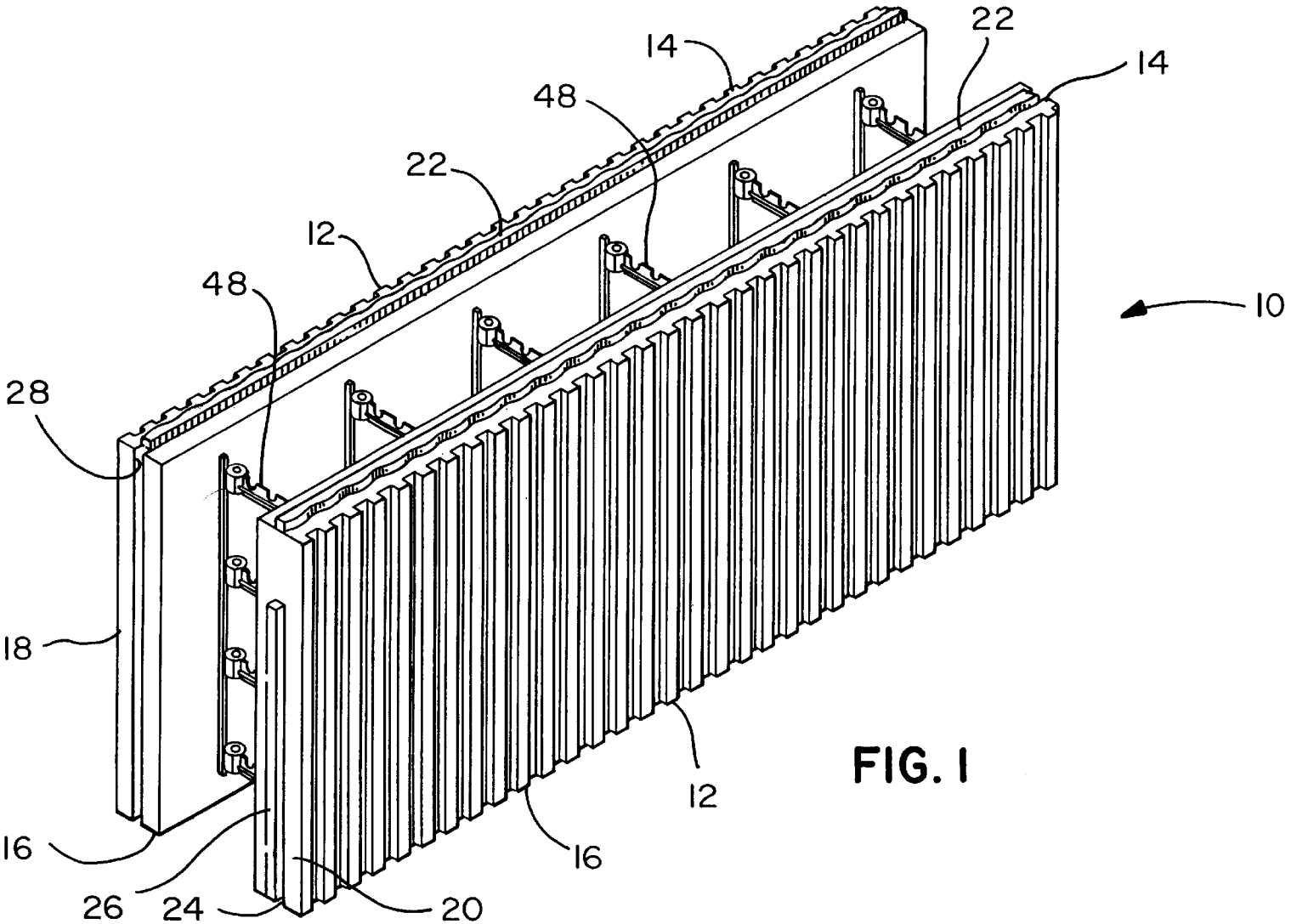
FIG. 1 is a perspective view of the assembly of the present invention having a pair of opposed insulation panels joined by a plurality of bridges.
Figure 1A:
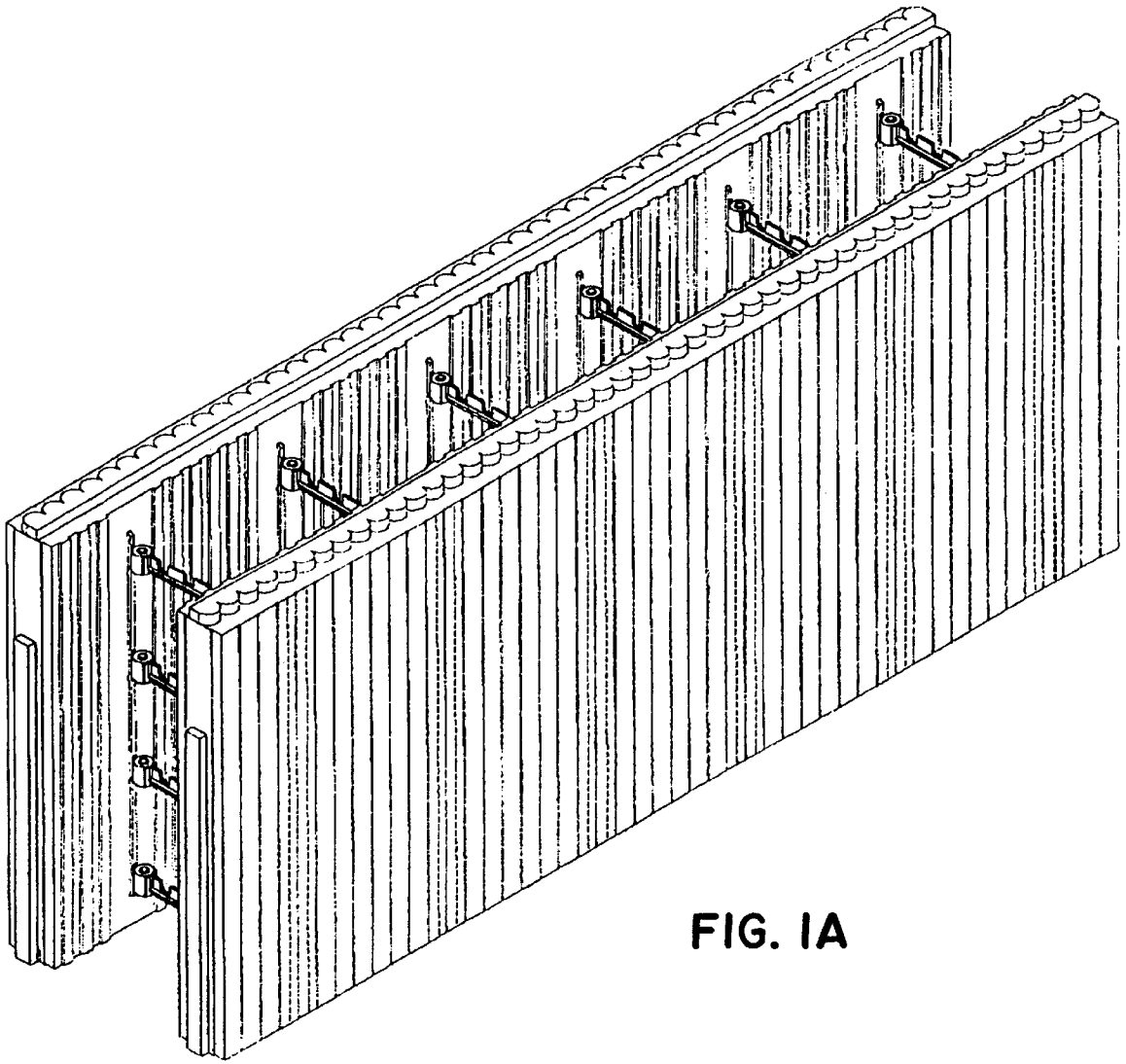
FIG. 1A is an alternate embodiment of FIG. 1.
Figure 2:
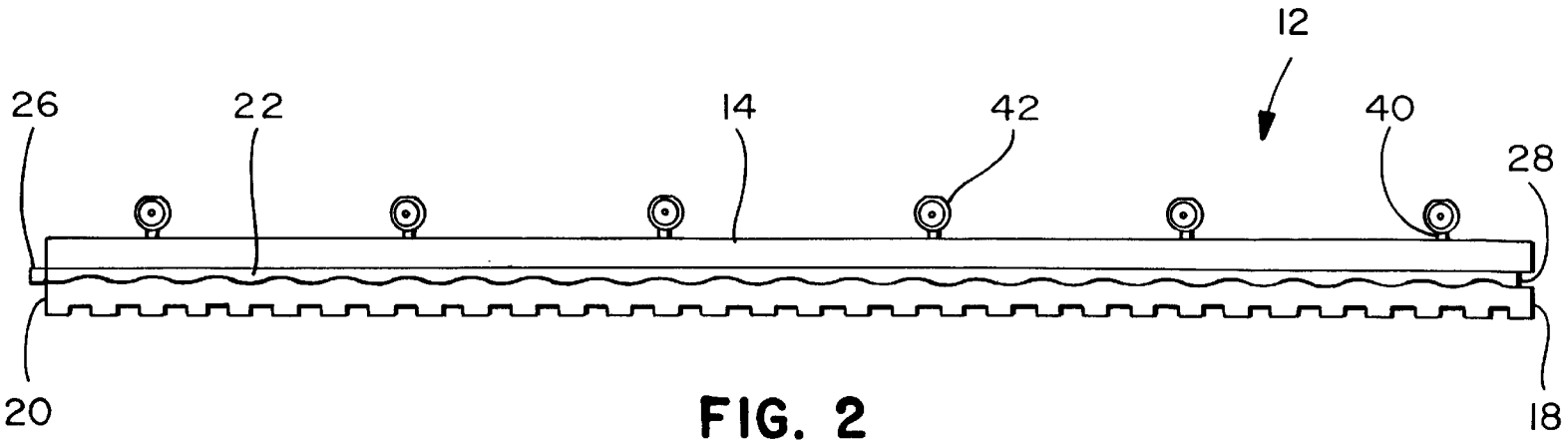
FIG. 2 is a top plan view of an insulation panel.
Figure 5:
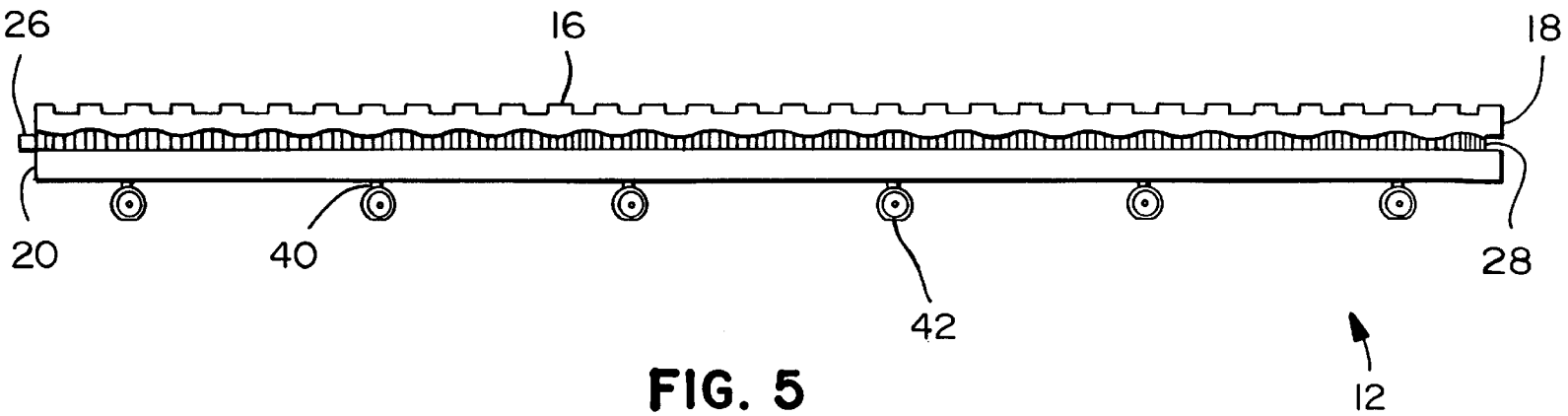
FIG. 5 is a bottom plan view of an insulation panel.
Figure 3:
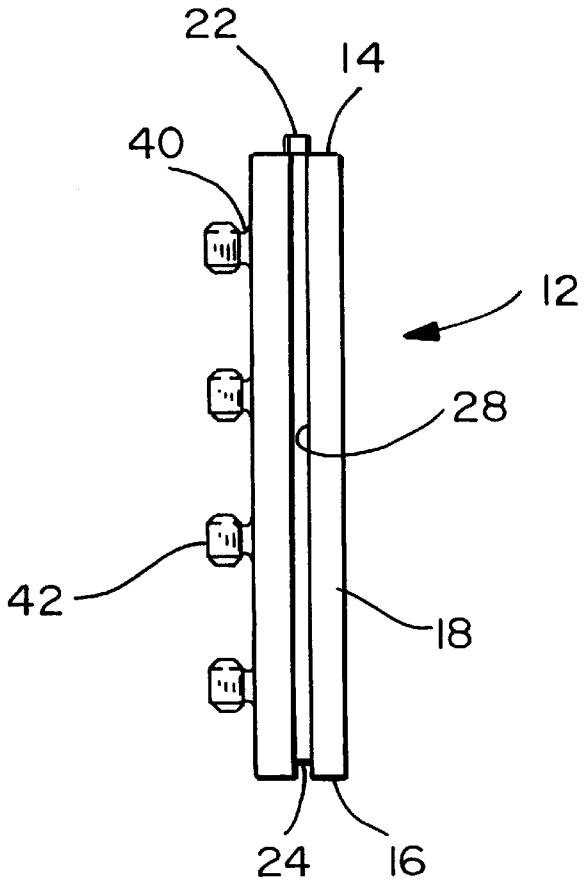
FIG. 3 is a right end view of an insulation panel.
Figure 4:
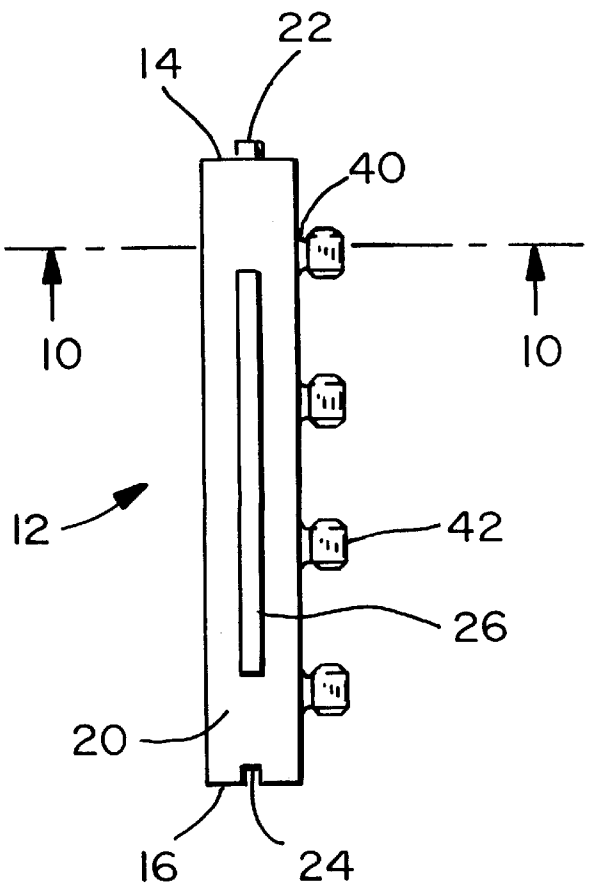
FIG. 4 is a left end view of an insulation panel.
Figure 6:
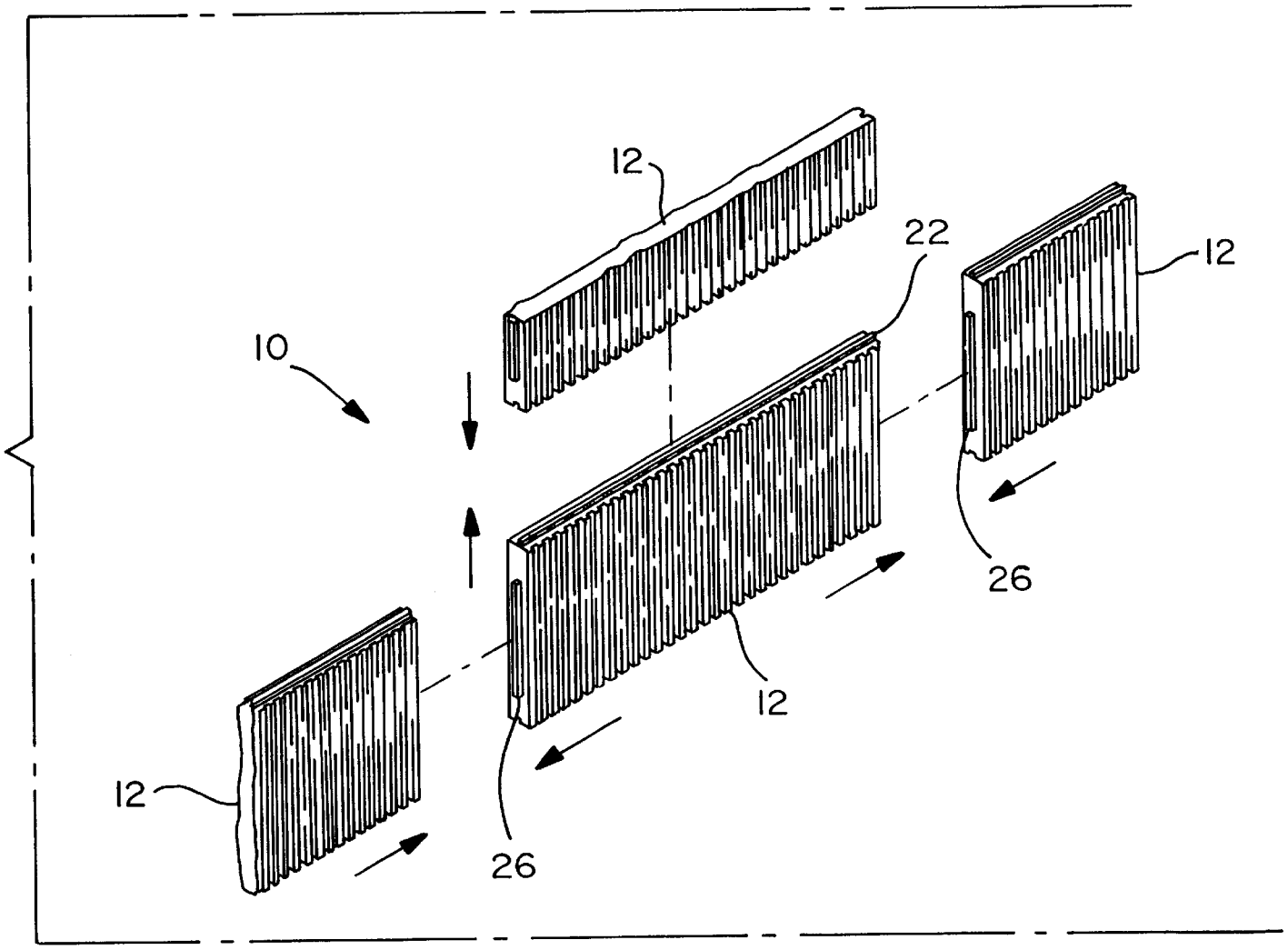
FIG. 6 is a perspective view showing the interlocking of adjacent panels.
Figure 8:
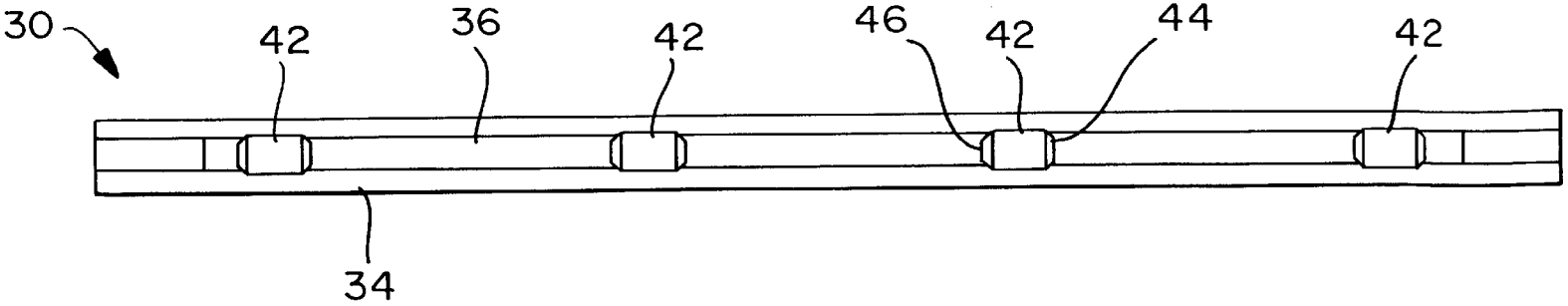
FIG. 8 is a top plan view of a stud of the present invention.
Figure 7:
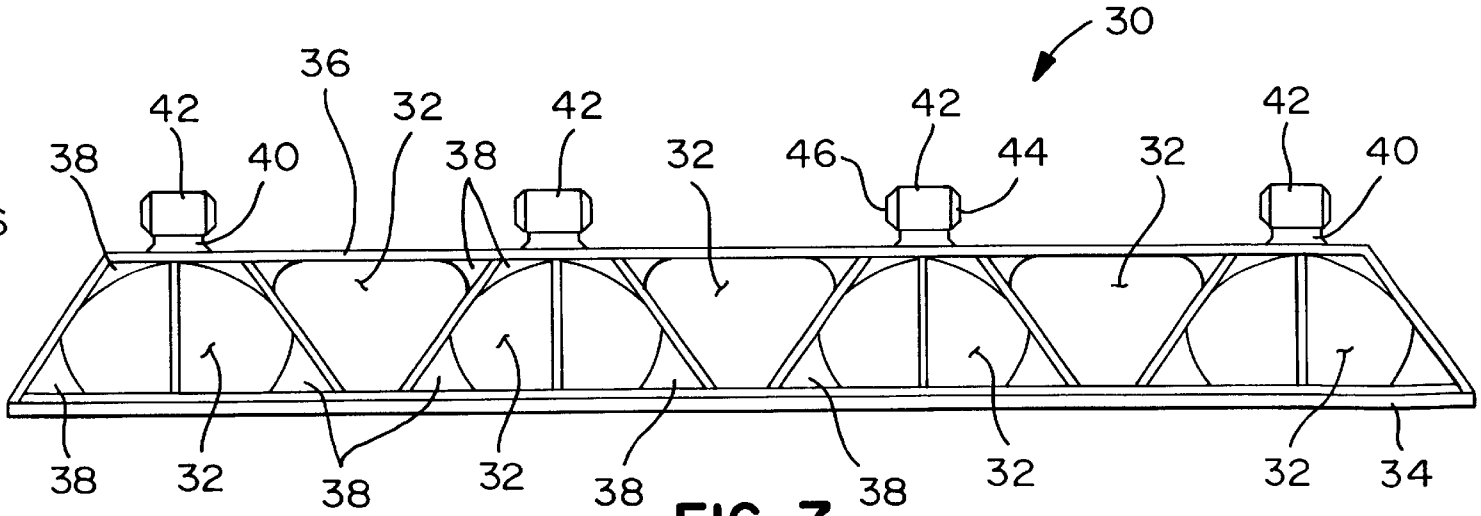
FIG. 7 is a side elevation view of a stud of the present invention.
Figure 9:
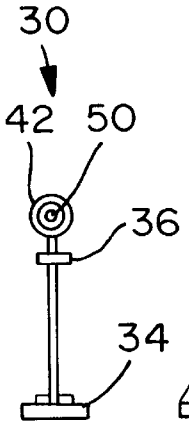
FIG. 9 is an end view of a stud of the present invention.
Figure 10:
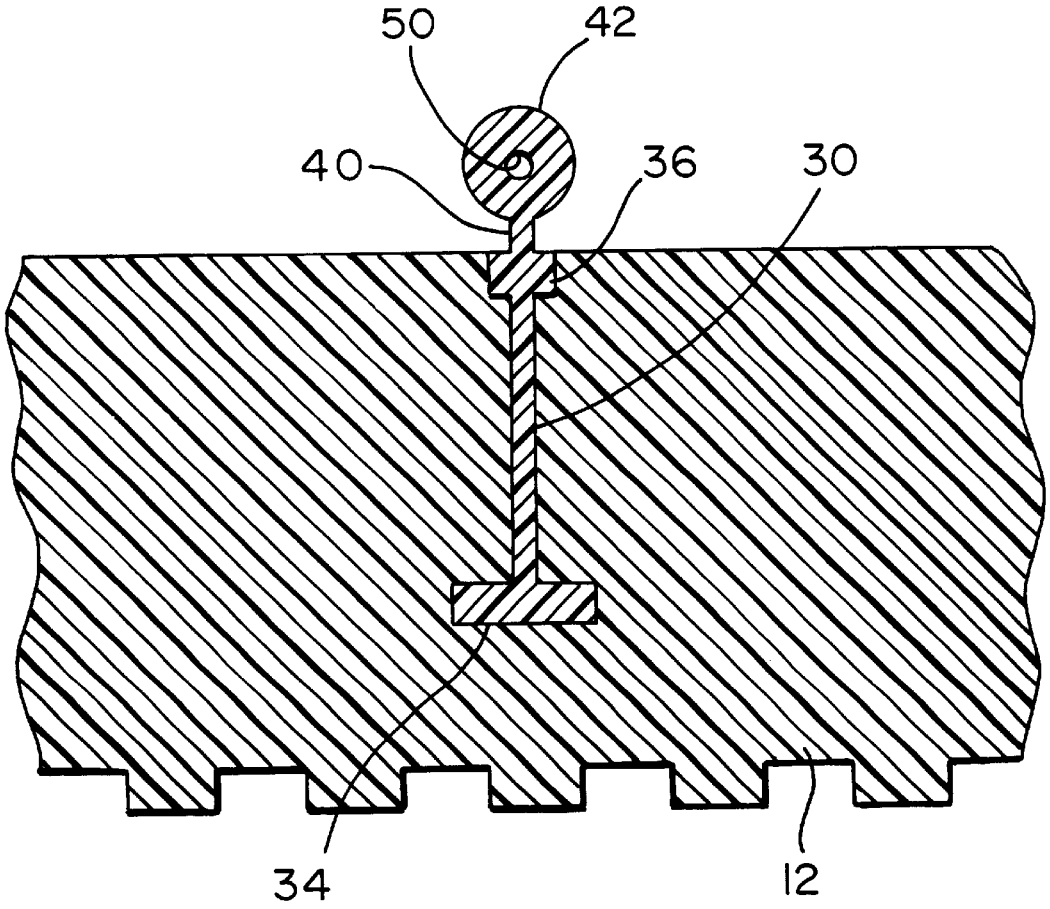
FIG. 10 is a cross-section view taken across the lines 10—10 of FIG. 4.
Figure 12:
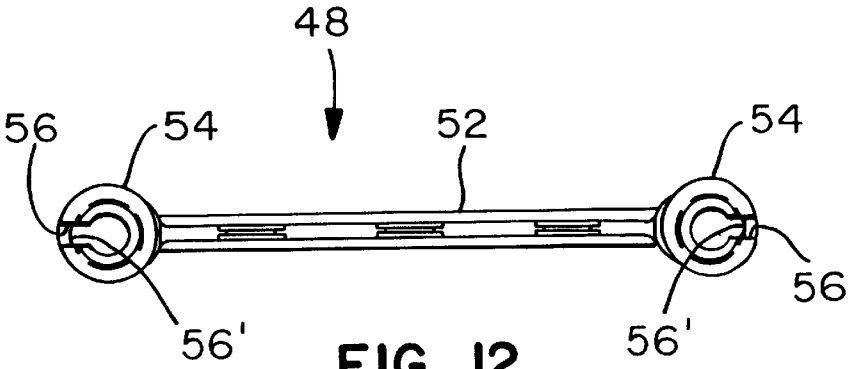
FIG. 12 is a top plan view of a bridge of the present invention.
Figure 11:
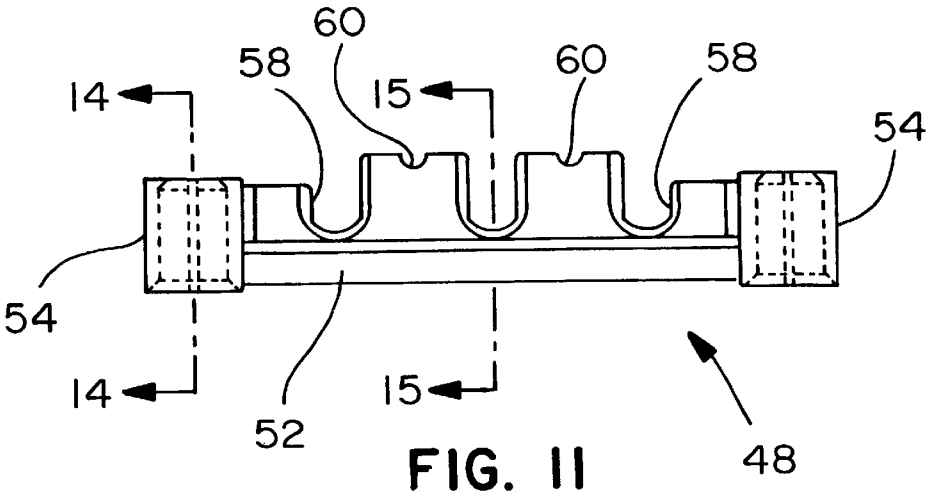
FIG. 11 is a side elevation view of a bridge of the present invention.
Figure 13:
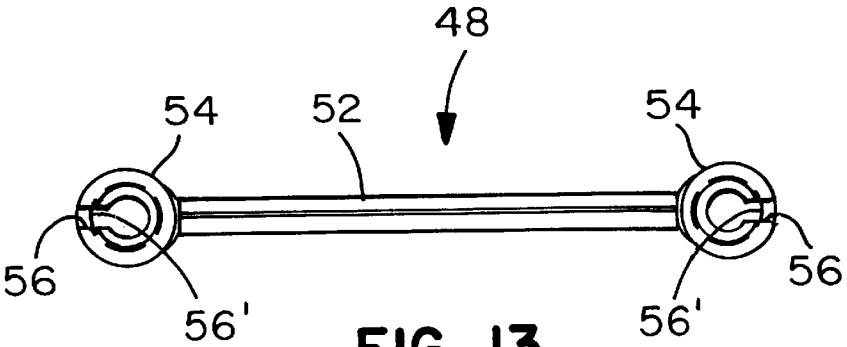
FIG. 13 is a bottom plan view of a bridge of the present invention.

Referring now to FIGS. 1–6, the concrete form assembly 10 is formed from a plurality of separate panels 12. Each panel is a molded plastic board preferably formed from flame retardant expanded polystyrene approximately 48" long, 20" high and 2.5" thick. Each panel has a top 14, bottom 16, right side 18 and left side 20. The top of each panel has a tongue 22 extending approximately ½" above the top of the panel which is approximately 1" wide at the thickest part. This tongue 22 has a straight side and a semi-circle design on the opposite side. This tongue is centered on the 2.5" edge of the panel with the straight edge directed toward the interior face of the panel and the semi-circle edge of the tongue directed toward the exterior face of the panel. The semicircles have a radius of ½". The bottom 16 of the panel has a groove 24 that cooperates with the tongue 22 on the top of another lower panel, such that the panel can easily be placed on top to interlock with the lower panel. The 20" edge of each panel has a rectangular tongue 26 on the left side. The tongue is approximately 15" long, is spaced approximately 5" from the top, extends out approximately ⅜" and is ¾" wide at the base and top. The opposite right side 18 of the panel has a groove 28 running the entire length of panel with corresponding dimensions to receive the tongue of an adjoining panel. In this manner, each panel may interlock on all four sides with adjoining panels. The inside of the panel preferably is a smooth surface leaving a smooth concrete surface but may have trace marking to assist in assembly. The exterior side of the panel may have trace indentions along the vertical dimension showing 1" increments through the full length of 48" (FIG. 1A).

Plastic studs 30 are imbedded in each panel. Two studs 20 are located approximately 4" on center from each end and the remaining four studs 20 are 8" on center from the two end studs. The studs 30 are parallel with respect to one another. Where the studs are located below the surface of the panel there are trace lines indicating the edges of the flat exterior facing part of the stud. These trace lines are ½" on each side of the inch mark indicator that corresponds to the center position of the stud 30.

Each stud 30 is a continuous piece of black injected molded plastic that is encased within the panel 12 (FIGS. 6–10). The side of the stud facing the exterior of the panel is approximately 1" wide and 3/16" thick with a centerized strip ½" wide by ⅛" thick running down the inside of this exterior facing piece. This exterior facing side is connected to the other side that faces the interior of the panel with a truss design of seven connecting trapezoidal members 32. A large trapezoidal member 32 is formed on each respective end of each stud 30 with alternating and inverted smaller and larger trapezoidal members 32 forming the stud. The bases 34 of each larger trapezoidal members are oriented toward the center strip and the exterior face of the respective panel 12. Gussets 38 are disposed in the acute angles between the base 34 and sides of each trapezoidal member 32 and also in the obtuse angles between the top 36 and sides of each of the larger trapezoidal members. The gussets 38 provide additional strength and rigidity to the studs 30. Disposed centrally on the tops 36 of each of the four larger trapezoidal members 32 is a respective connector member 40. The connector member 40 extends outwardly from the inner face of the respective panel 12. The connector members 40 have curved upper and lower edges to minimize stress. A barrel or cylinder 42 is connected to each connector member 40. Each cylinder 42 has a tapered top 44 and bottom 46 to enable a bridge 48 to be slipped over the cylinders from either the top or bottom direction of the cylinder as will be explained. The cylinder 42 has a slightly larger than ⅛" hole 50 through the center. Thus, each panel 12 has a plurality of rows of vertically aligned cylinders extending from the inner face of each panel 12. The cylinders are connected to studs 30 which are encased in the panel 12 and are not visible.

Figure 15:
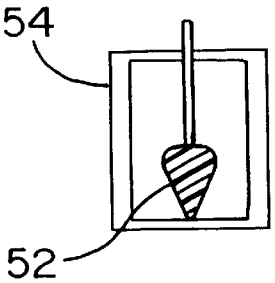
FIG. 15 is an enlarged cross-section view taken across the lines 15—15 of FIG. 11.
Figure 14:
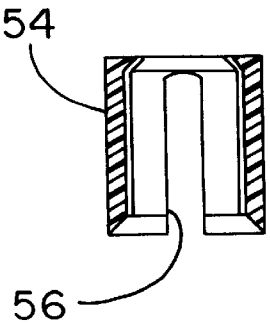
FIG. 14 is an enlarged cross-section view taken across the lines 14—14 of FIG. 11.
Figure 16:
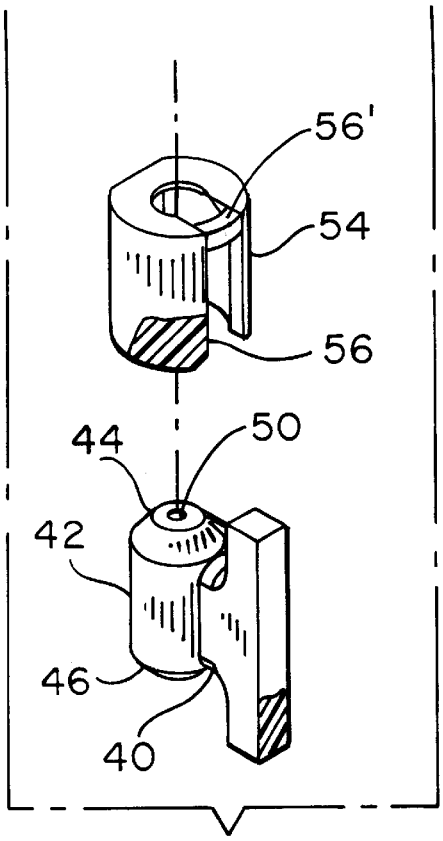
FIG. 16 is a perspective view of the collar on the bridge being seated on the cylinder from the stud.
Figure 17:
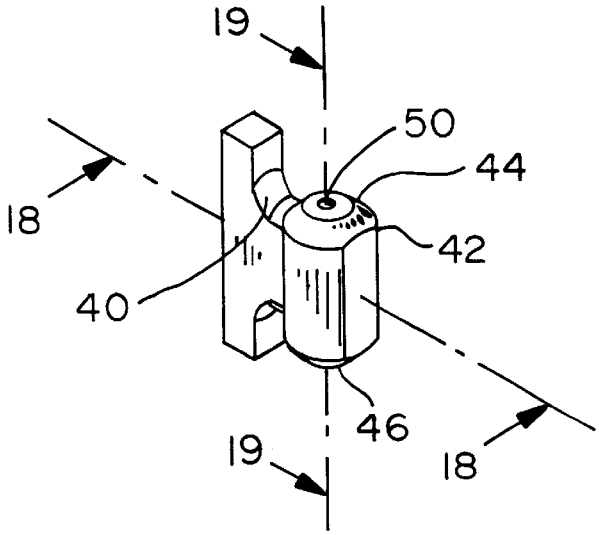
FIG. 17 is a perspective view of the cylinder attached to the stud.
Figure 18:
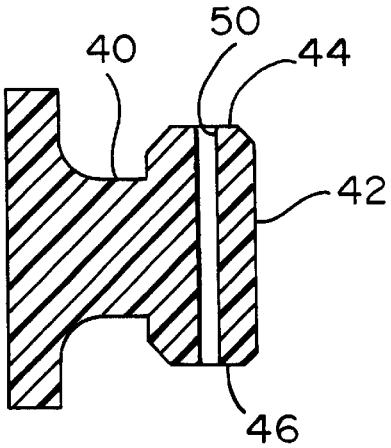
FIG. 18 is a cross-section across lines 18—18 of FIG. 17.
Figure 19:
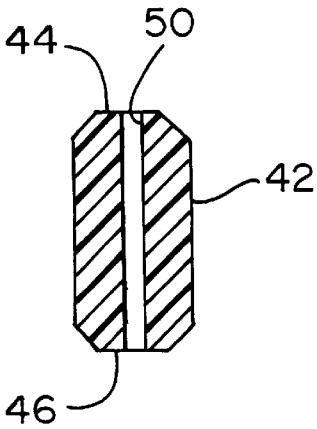
FIG. 19 is a cross-section across lines 19—19 of FIG. 17.

A plurality of bridges 48 are provided. Each bridge 48 has a body 52 with a length, a first end and an opposite second end shown in FIGS. 1–15. Each end of the body 52 has a respective collar 54 formed thereon. Each collar 54 is a hollow cylinder which has a slot 56 formed in the collar opposite from the body 52. The slot 56 extends the entire height of the collar 18 (FIGS. 14 and 16) and, preferably, has a stop 56'. The bridges are disposed perpendicularly between the interior faces of the opposite walls with the cylinders 42 extending from the respective interior faces of the panels. The cylinders 42 are frictionally seated within the collars 54 on the ends of the bridges 48. The connector member 40 attached to each respective cylinder 42 is received in the respective slot 56 in the collar 54 such that the collar 54 straddles the connector member 40 (FIG. 16). Added reinforcement (stop 56') is provided at the top of each collar where the slot is formed. Further, the top of each collar 54 is tapered internally to cooperate with the tapered top 44 (or bottom 46) of the cylinder 42. When the bridge 48 is disposed between the two walls, the top of the cylinder 42 is flush with the top (or bottom) of the collar 54. The lowermost portion of the body 52 of the bridge preferably has an inverted triangular shape (FIG. 15) and is connected to the bottoms of the cylinders 42 at opposite ends of the body. This shape enables the concrete to flow in a uniform manner around the bridge to reduce cavities within the concrete. The upper portion of the body 52 above the inverted triangular bottom has at least one U-shaped groove 58 formed transversely in the length of the bridge 48. The grooves 58 accept reinforcing steel rods if needed during construction. Also formed in the top of the body 52 is at least one notch 60, to be used as will be described.

In a preferred embodiment, the studs 30 and cylinders 42 are formed from a colored or black plastic. The bridges 48 and the collars 54 are formed from a colorless or transparent plastic. Thus, when the bridges 48 are disposed on the cylinders 42, visual inspections can assure proper seating for maximum strength. However, the studs and/or the bridges may be formed of any color plastic as desired.

Also, the bridge 48 may be formed of any desired length to provide desired spacing between the walls depending upon the thickness required for the particular construction.

Figure 20:
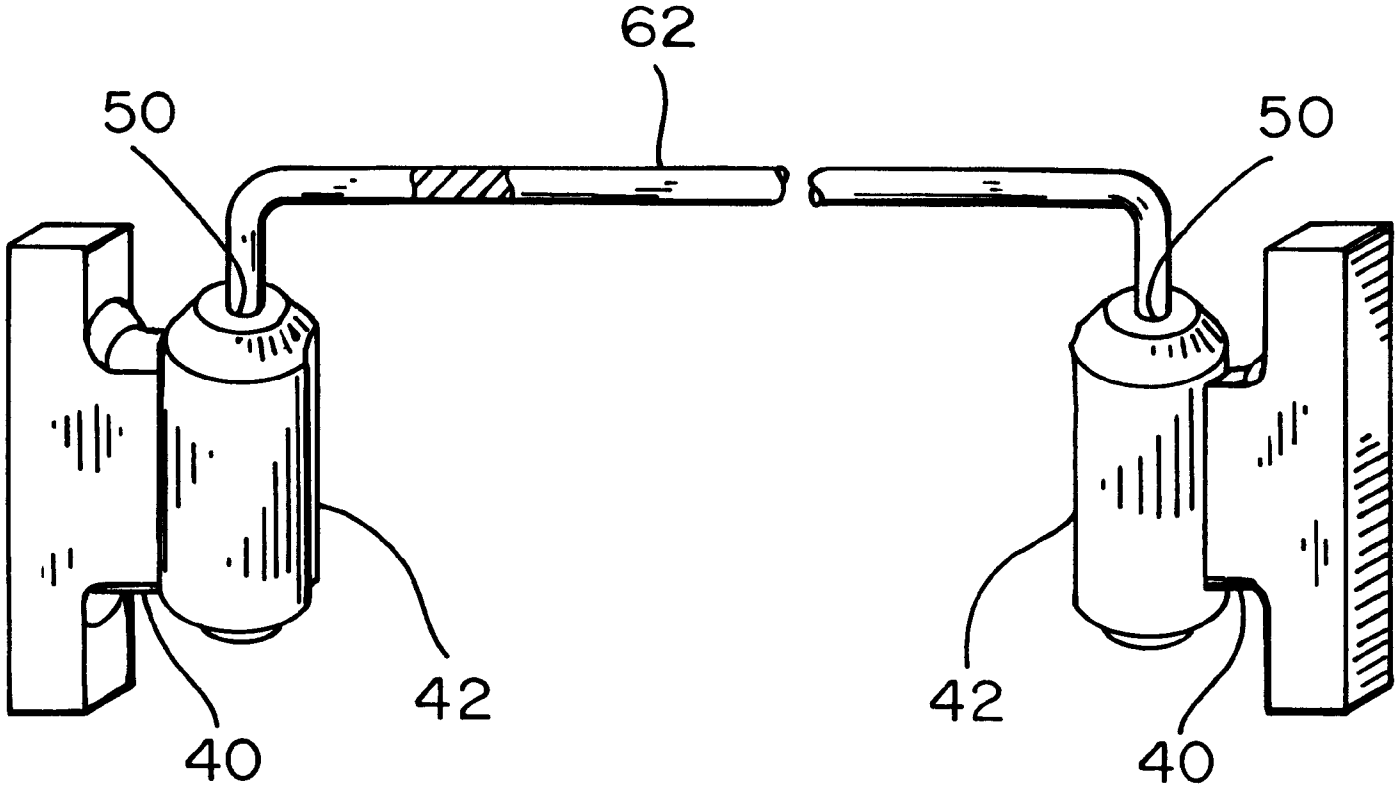
FIG. 20 is a side elevation view of the inverted U-shaped rod being disposed in the axial holes in cylinders.
Figure 21:
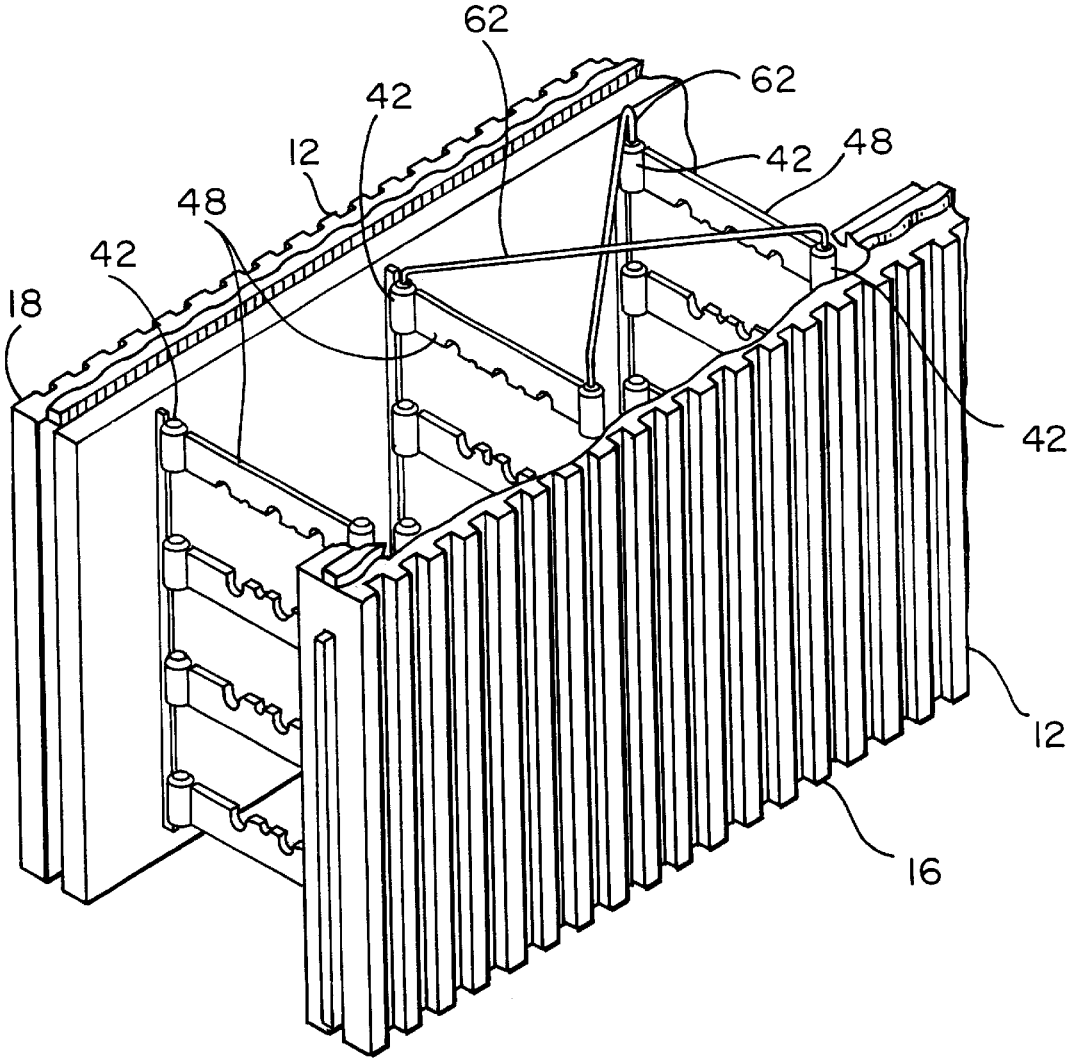
FIG. 21 is a partially cut-away perspective view showing the U-shaped rod disposed diagonally between two insulation panels.
Figure 22:
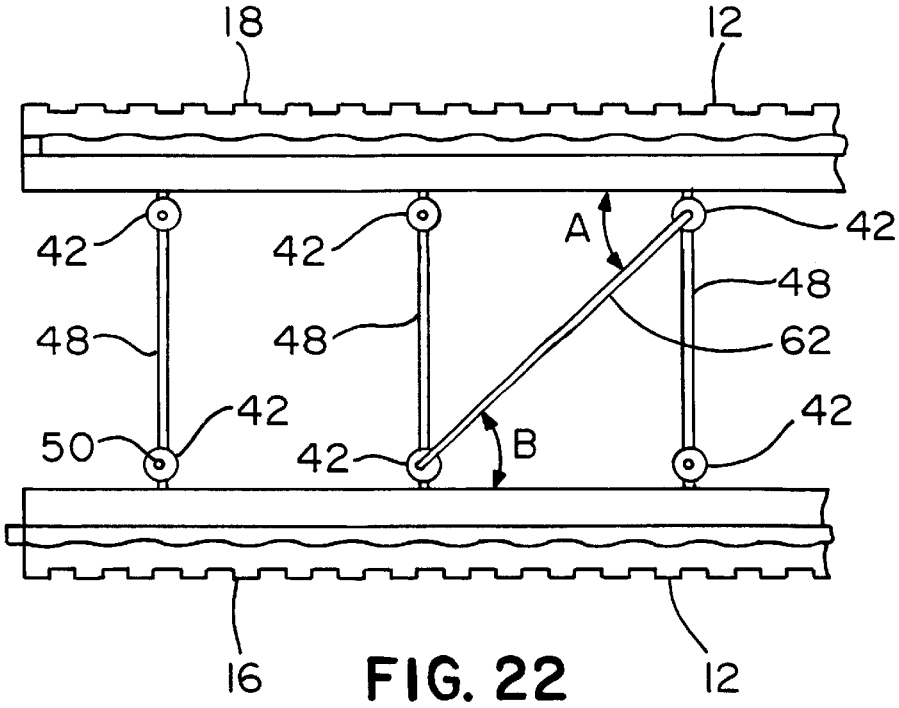
FIG. 22 is a top plan view showing two inverted U-shaped rods of different lengths, a shorter rod perpendicular to the panels and a longer rod mounted diagonally with respect to the panels.

Referring now to FIGS. 20–22, a U-shaped metal wire rod 62 is provided. The rod 62 has a base and two legs at right angles to the base. The rod is inverted, one leg is received in the axial hole 50 formed centrally in one of the cylinders 42 selected on the first panel and the other leg is received in the axial hole 50 formed centrally in another of the cylinders selected in the opposite second panel. The U-shaped rod 62 may have a length approximately the same as the length of the bridge 48 so that the rod may be received in the same cylinders as the bridge. Alternately, the rod may be received approximately perpendicularly to the panels in cylinders in which no bridge has been disposed. In still another option, the U-shaped rod may have a length greater than the length of the bridge and the U-shaped rod may be disposed diagonally between the first and second panel connecting the axial holes in cylinders which are offset from one another. Thus, the U-shaped rod is disposed at an acute angle A with respect to one panel and at a complementary obtuse angle B with respect to an opposite panel as shown in FIG. 22. Several U-shaped rods may be utilized to provide an X-shaped support between the opposed panels. The U-shaped rods also serve as bridges to provide lateral strength and improved rigidity to the assembly. Preferably, the U-shaped rod has a dimple, or two adjacent bumps, formed on the base as will be explained.

Figure 24:
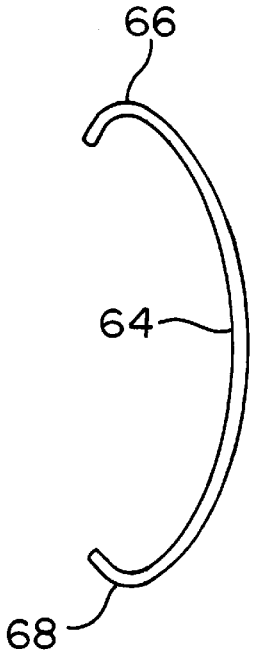
FIG. 24 is a perspective view of the hold-down clip.
Figure 25:
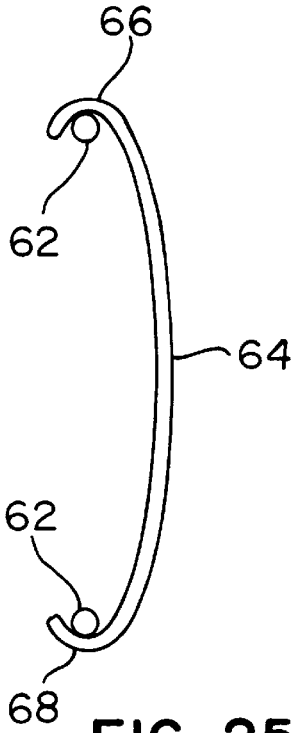
FIG. 25 is a perspective view of the clip disposed between two rods.
Figure 23:
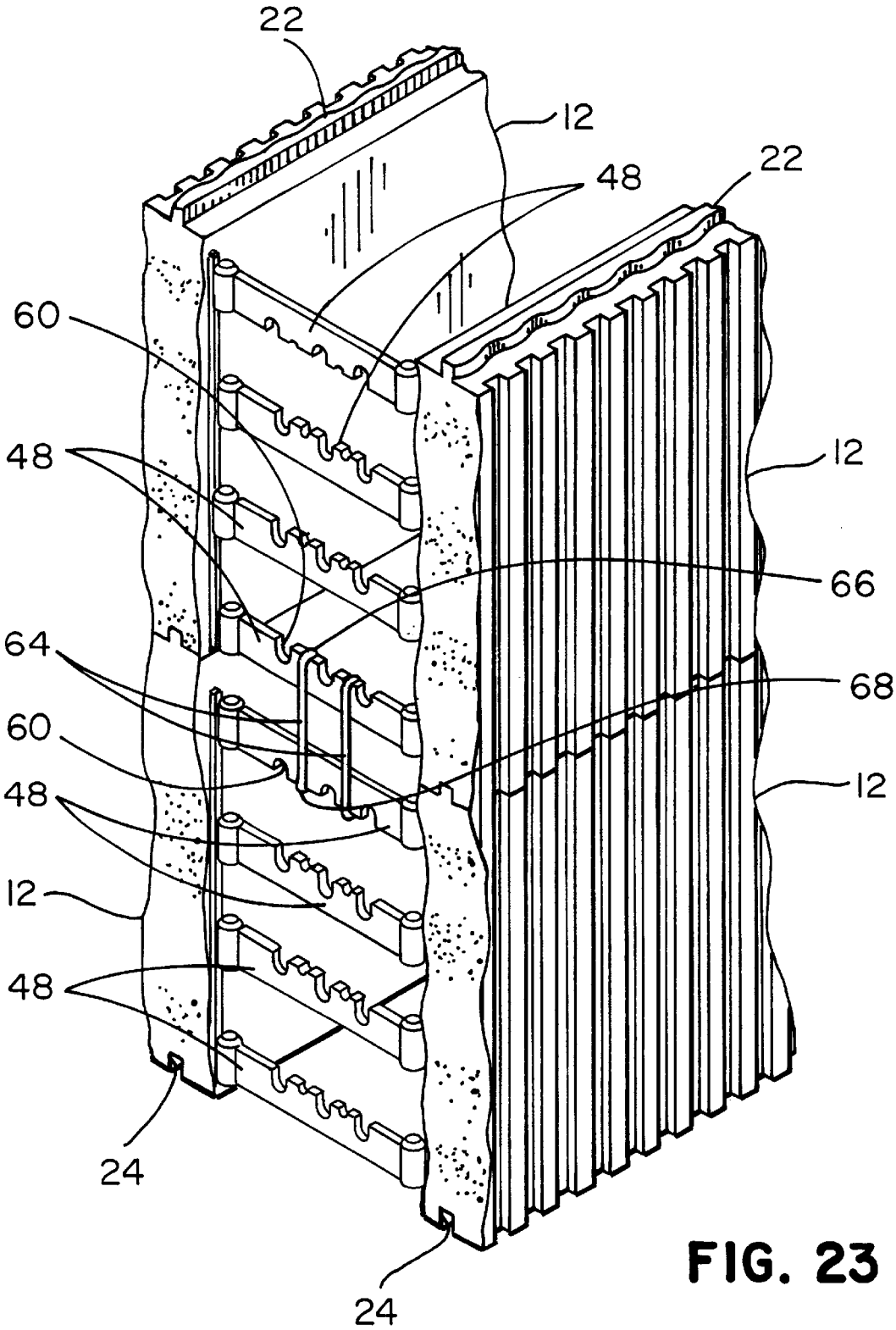
FIG. 23 is a side elevation view showing the hold-down clip disposed between an upper bridge and in inverted lower bridge on adjacent panels.
Figure 26:
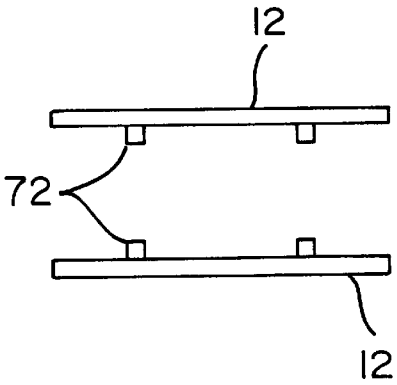
FIG. 26 shows two opposed panels with inwardly disposed projections on the panels.
Figure 27:
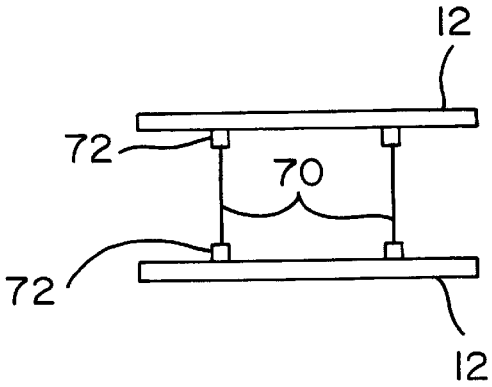
FIG. 27 shows two perpendicular wire rod bridges between the respective projections on the opposed panels.
Figure 28:
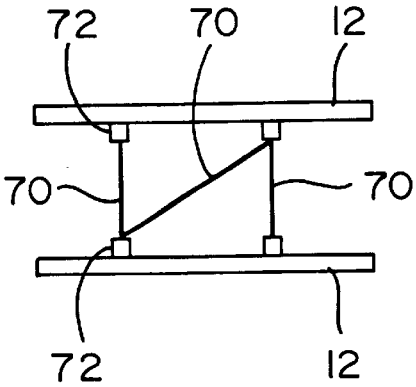
FIG. 28 shows FIG. 27 with a diagonally-disposed wire rod bridge.
Figure 29:
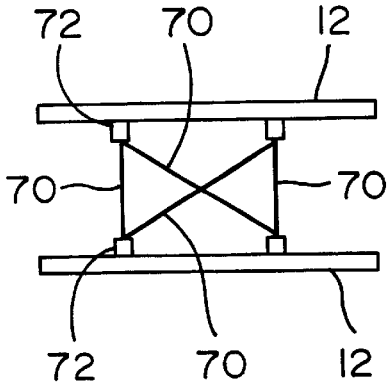
FIG. 29 shows FIG. 28 with an additional diagonally-disposed wire rod bridge crossing the first diagonal bridge.
Figure 30:
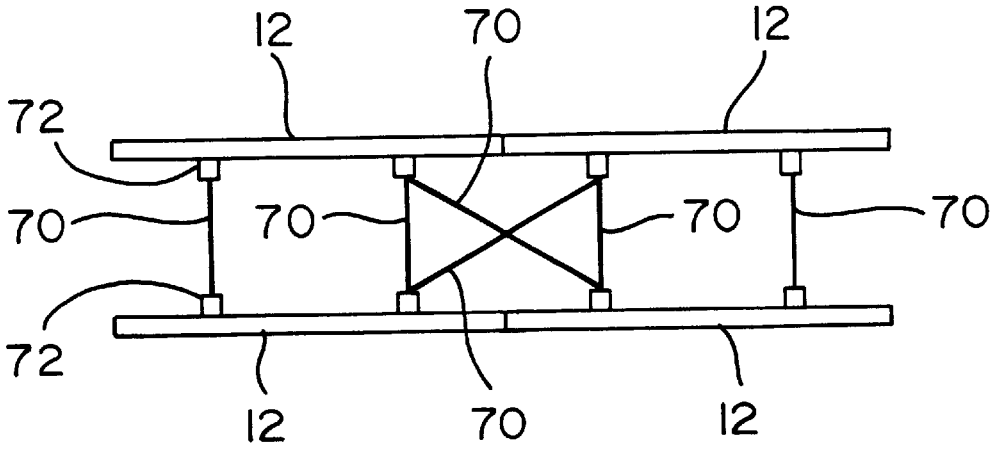
FIG. 30 shows two pairs of panels disposed side-by-side with two diagonally-disposed wire rod bridges connecting each pair of adjacently-disposed panels.
Figure 31:
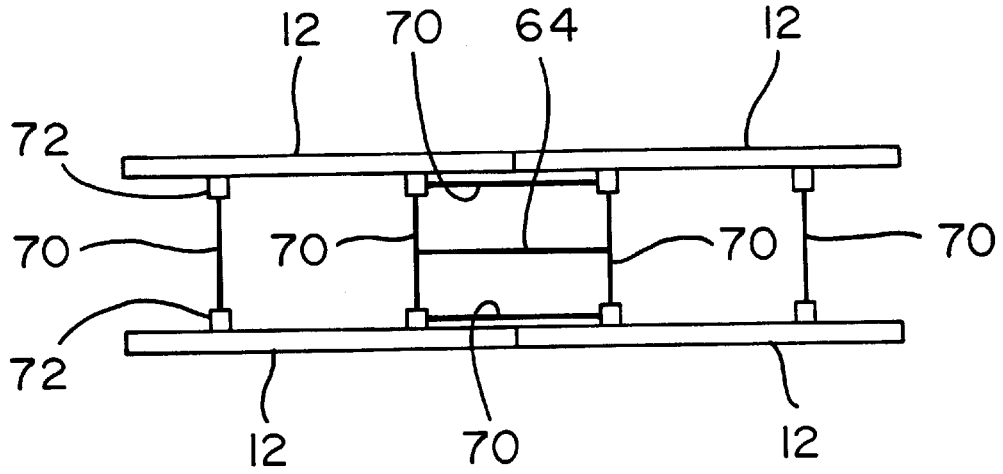
FIG. 31 shows two pairs of panels disposed side-by-side with a hold-down clip disposed between wire rod bridges on the adjacently-disposed panels.
Figure 32:
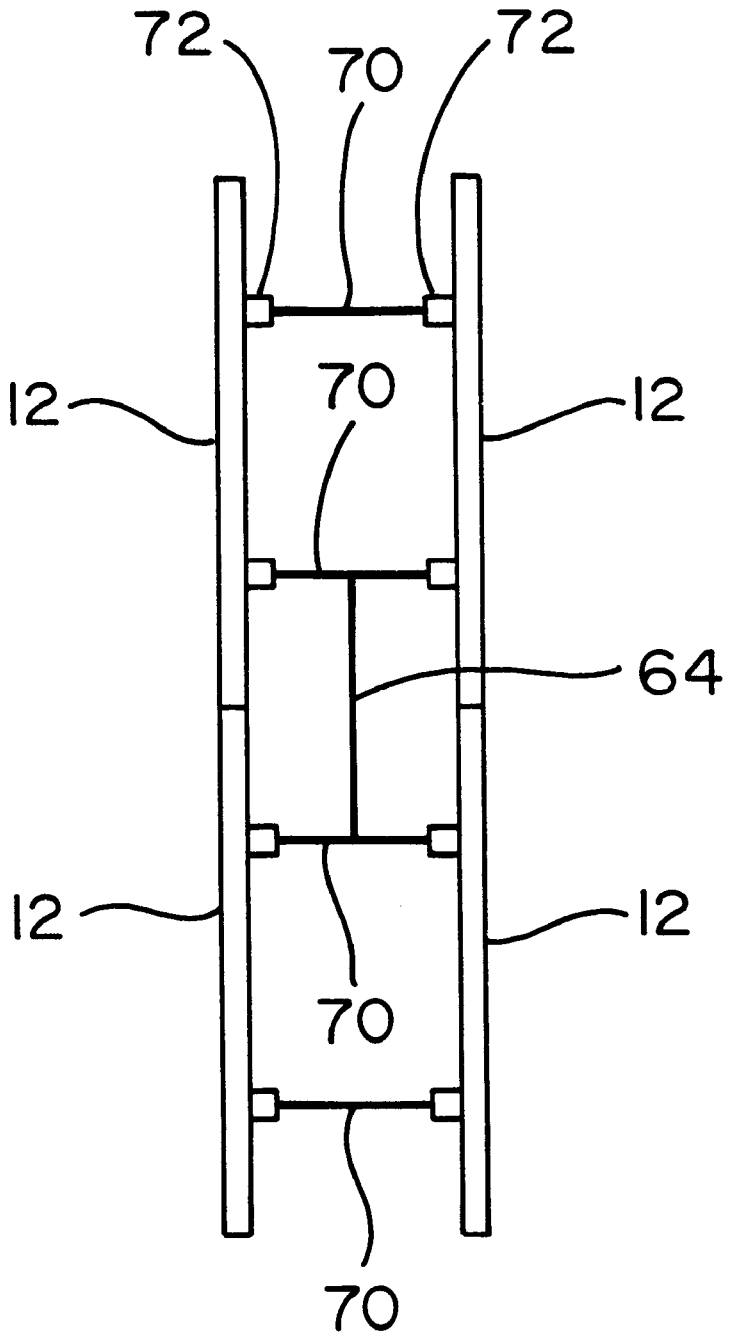
FIG. 32 shows two pairs of vertically-disposed opposite panels having a hold-down clip between wire rod bridges on the upper panels and the wire rod bridges of the lower panels.

As shown in FIGS. 23–25, a hold-down clip 64 is a resilient member having a hooked first end 66 and an opposite hooked second end 68. The first end 66 is engaged in the at least one notch 60 in a first selected bridge 48 connected to a selected panel 12. The hooked second end 68 is engaged in the at least one notch 60 in a second selected bridge 48 connected to a selected panel 12 which is vertically disposed with respect to the first selected panel. The second selected bridge is under the first selected bridge. The second selected, or lower, bridge is disposed in an inverted position with respect to the first selected, or upper, bridge. Since the lower bridge is inverted, the collars 54 on both ends of the lower bridge are received on the bottoms 46 of the cylinders. In this manner, the hold-down clip 64 urges the upper bridge and the lower bridge toward one another and the lower bridge is more securely engaged to the cylinders on the lower panel. Alternately, the hold-down clip 64 may engage the U-shaped metal rod 62 (FIG. 20). If desired, a dimple (not shown) may be formed in the rod 62. The length of the hold-down clip may be any desired length to connect the cylinders of the two adjacent vertical panels. Preferably, the hold-down clip 64 is formed of metal but may be plastic. Positive tension must be provided by the hold-down clip to snap over the upper bridge and the lower bridge. The use of the hold-down clip 64 provides increased strength and stability to the joined and vertically disposed panels. The hold-down clip assists in preventing the separation of vertically adjacent panels. The hold-down clip 64 may alternately be used with side-by-side panels connecting the respective bridges between the panels and providing additional strength.

Figure 35:
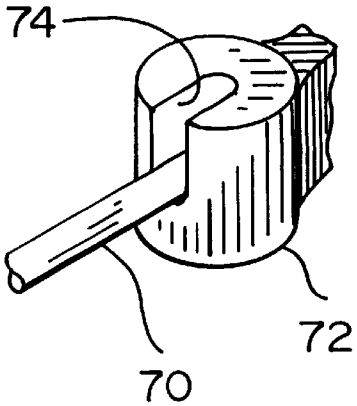
FIG. 35 is a perspective view showing a wire rod received in a slot formed in the cylinder of FIG. 17.
Figure 34:
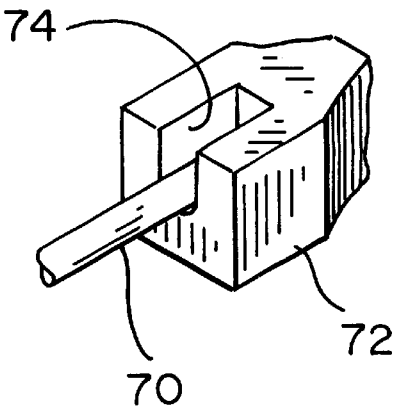
FIG. 34 is a perspective view showing a wire rod received in the slot in the projection of FIG. 33.
Figure 33:
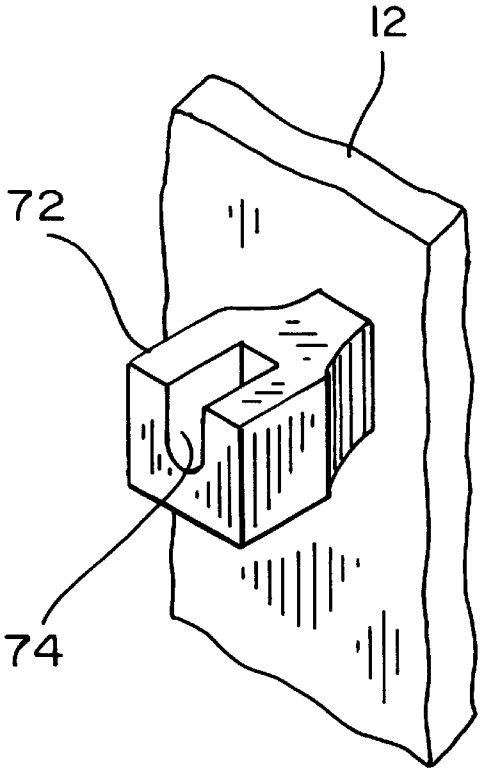
FIG. 33 is a perspective view of the inwardly-disposed projection on the panel.
Figure 38:
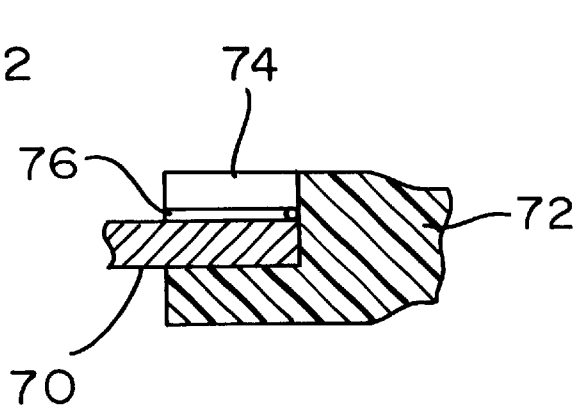
FIG. 38 is a cross-sectional view taken across the lines 38—38 of FIG. 37.
Figure 37:
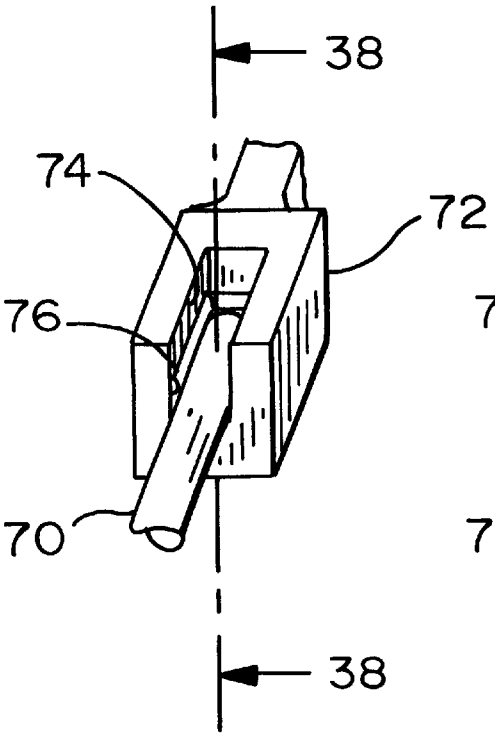
FIG. 37 is a perspective view of a wire rod received in the slot of FIG. 36.
Figure 36:
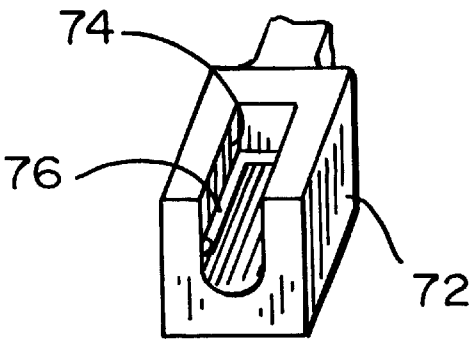
FIG. 36 is an enlarged perspective view of a protrusion formed in the slot in the projection.

In an alternate embodiment, as shown in FIGS. 26–32, wire rods 70 may be disposed between the inwardly-disposed projections 72 on the studs. The wire rods 70 may be similar to the U-shaped rods 62 discussed above or may be a rod without the legs at right angles to the base. The wire rod 70 may be a straight rod, preferably metal, the end of which is received in the projection 72 by friction fit. As shown in FIGS. 33–34, the rod may be supported in a slot 74 in the projection 72 or as shown in FIG. 35, a slot 74 in the cylinder 42 (which is, in fact, a projection). The slot 74 may have a protrusion 76 or bead formed internally therein (FIG. 36) which permits the end of the wire rod 70 to pass as the wire rod 70 is introduced from the top of the slot 74 but which restricts the wire rod 70 from being removed from the slot 74. In other configurations the ends of the wire rod 70 may be flanged like the head of a nail, may have a knob or bulbous end or may have other geometrical configurations. The slot 74 in the projection 72 may then have a cooperating shape to facilitate the receiving and engaging of the end of the wire rod 70 in the slot 74. The use of the wire rod 70 as a bridge between the opposing panels can reduce costs of having a molded bridge. Furthermore, metal wire rods eliminate the possibility of combustion or melting of plastic bridges in the event of fire. The metal wire rods also serve as reinforcing rods for the concrete. The wire rods 70 may be connected either vertically or horizontally with the hold-down clips 64 to provide additional support between adjacent panels either vertically or horizontally. The same numeral 70 has been used to designate the wire rods 70 (FIGS. 30, 31) regardless of length; and it will be appreciated by those skilled in the art that different lengths will be required for the particular construction.

Figure 39:
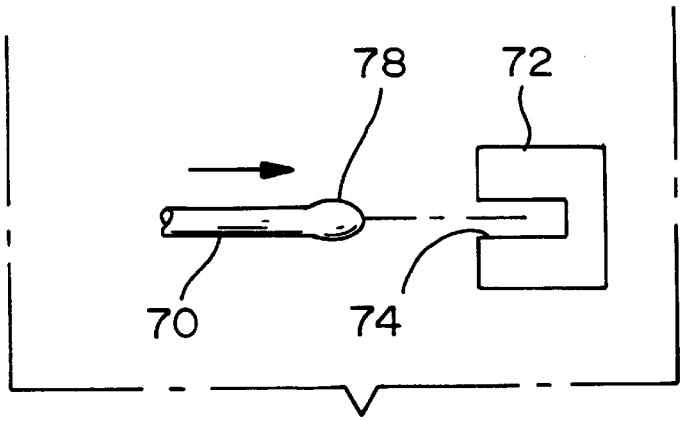
FIG. 39 is a top plan view of an alternate embodiment of a wire rod to be received in a slot in the projection.
Figure 40:
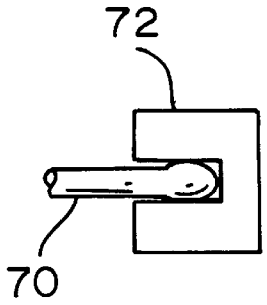
FIG. 40 is a top plan view of the wire rod of the embodiment of FIG. 39 received in the slot.
Figure 41:
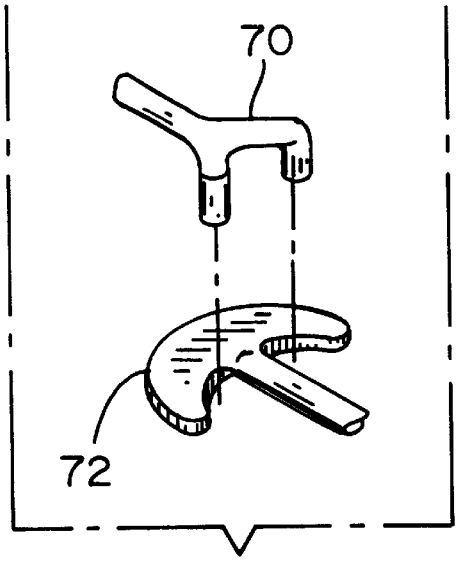
FIG. 41 is a perspective view of a rod with bifurcated legs and a receiving projection.
Figure 42:
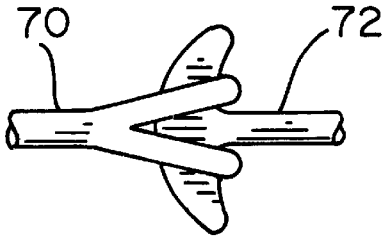
FIG. 42 is a top plan view of the embodiment of FIG. 41 showing the rod connected to the projection.
Figure 43:
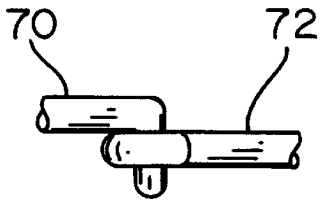
FIG. 43 is a side elevation view of FIG. 42.

FIGS. 39–42 show alternate embodiments of the wire rod 70 and projection 72. FIGS. 39 and 40 show a wire rod 70 with a slight enlargement or bulbous end 78 which is received in a slot 74 in the projection. The slot 74 has a width slightly smaller than the bulbous end 78 and provides a snug friction fit to insertion of the end 78 into the slot. The rod with the bulbous end is relatively inexpensive and no special tools are required to engage the rod in the projection. FIGS. 41–43 show a rod 70 having a bifurcated end with bent portion on each bifurcated segment. The projection 72 has a letter E shape to receive the respective bifurcated segments on opposite sides of the center supporting member of the E-shaped projection. This embodiment is easily assembled in a minimum of time. There are many variations of the shape and style of both the wire rod and the projection which may be used. These include geometrical shapes for both the ends of the wire rods and openings in the projection.

The concrete form assembly of the present invention provides a stronger, less costly assembly with design flexibility for use by architects, engineers and construction companies. An improved and easily assembled bridge and connector is provided between the opposed panels. Wire rods and inverted U-shaped rods provide an inexpensive and easily assembled means for strengthening the form assembly against lateral movement. The wire rods and U-shaped rods may be an independent cross tie or may be used in conjunction with the bridges, being connected to the same projection from the stud on the inner wall of the panel. The hold-down clip provides increased strength to the panels in either a vertical or a horizontal direction. When concrete is poured into the assembly, the wire rods, the U-shaped rods and the hold-down clip provide additional reinforcement to the concrete.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A concrete form assembly for construction of structures, the assembly comprising:

at least a first and a second rectangular insulation panel, each panel having respectively a top, a bottom, a first side, an opposite second side, an inner face and an outer face, a plurality of studs, each stud being a molded plastic strip being formed from a plurality of adjoining trapezoidal members with gussets, each stud having a first end and an opposite second end, a plurality of spaced-apart cylinders being formed on each stud between the first end and the second end thereof, each cylinder being connected to the stud by a connector member, each cylinder having a respective axial hole formed therein, the studs being encased in the respective inner faces of the at least two panels between the tops and the bottoms thereof, wherein the connector members and the cylinders extend outwardly from the respective inner faces of the panels, the studs being parallel to one another and spaced apart by a uniform selected distance, a plurality of bridges, each bridge having a body with a length, a first end and an opposite second end, a collar being formed respectively on the first end and the second end of each bridge, each collar being a hollow cylinder having a slot formed opposite from the body, wherein a selected number of bridges may be disposed between the first panel and the second panel with selected cylinders on the respective panels being frictionally seated in the collars to connect the inner face of the first panel to the inner face of the second panel, the respective slots in the collars straddling the respective connector members, in this manner, the first panel is connected to the second panel by the plurality of bridges and the panels are spaced apart by a distance determined by the length of the bridge such that concrete may be introduced into the space between the inner faces of the first panel and the second panel.

2. The concrete form assembly of claim 1, further comprising each cylinder having an axial hole formed therein, an inverted U-shaped rod having a base with a desired length and two legs at right angles to the base, wherein one leg is received in the axial hole of a selected cylinder on the first panel and the other leg is received in the axial hole in a selected cylinder on the second panel such that further support is provided to maintain the first panel at the distance from the second panel.

3. The concrete form assembly of claim 2, wherein the inverted U-shaped rod is disposed approximately perpendicularly to the first panel and to the second panel.

4. The concrete form assembly of claim 2, wherein the inverted U-shaped rod is disposed at an acute angle with respect to the first panel and at a complementary obtuse angle to the second panel.

5. The concrete form assembly of claim 1, further comprising each bridge having an upper surface having at least one notch formed therein, a hold-down clip, the hold-down clip having a hooked first end and an opposite hooked second end, wherein the hooked first end of the hold-down clip is received in the at least one notch in a first selected bridge connected to a selected panel and the hooked second end of the hold-down clip is received in the at least one notch in a second selected bridge connected to a panel vertically disposed with respect to the selected panel, the second selected bridge being under the first selected bridge and being is disposed in an inverted position with respect to the first selected bridge, wherein increased strength and stability is provided to the joined vertically disposed panels.

6. The concrete form assembly of claim 1, wherein each cylinder on each stud has a tapered top end, each collar on each bridge having a complementary tapered inner top surface, wherein the collars and the cylinders cooperate for maximum strength.

7. The concrete form assembly of claim 1, wherein cylinders on the studs are colored and the collars on the bridges are transparent such that visual inspection indicates proper seating of the cylinders within the collars.

8. The concrete form assembly of claim 1, wherein the stud is formed from adjoining trapezoidal members, each trapezoidal member having a shorter top and a longer bottom and connecting legs therebetween, the adjacent trapezoidal members being inverted with respect to tops and bottoms.

9. The concrete form assembly of claim 8, further comprising a gusset disposed between each connecting leg and each bottom of each trapezoidal member.

10. The concrete form assembly of claim 8, further comprising a gusset disposed in the obtuse angle formed between the shorter top and the connecting legs of each alternate trapezoidal member.

11. The concrete form assembly of claim 1, wherein each cylinder has a top and a bottom and a uniform diameter therebetween such that the collar on the bridge may be seated from the top or the bottom of the cylinder.

12. In a concrete form assembly for construction of a structure having at least two rectangular insulation panels each having a top, a bottom, two opposite sides and an inner face, means for interlocking a plurality of panels in their respective tops, bottoms and sides to form a first wall and a second opposite wall, the improvement comprising:

a plurality of studs encased in each panel between the respective tops and bottoms thereof, each stud having a plurality of spaced-apart cylinders formed thereon wherein the respective cylinders extend outwardly from the inner face of each panel, a plurality of bridges, each bridge having opposite ends, a collar being formed on the opposite ends of each bridge, a selected number of bridges being disposed perpendicularly between the first wall and the second wall wherein the respective cylinders are seated in the respective collars to connect and spaced-apart the inner faces of the at least two panels of the opposite walls such that concrete may be introduced between the at least two panels.

13. The concrete form assembly of claim 12, further comprising each stud formed from adjoining trapezoidal members, each trapezoidal member having a shorter top and a longer bottom and connecting legs therebetween, the adjacent trapezoidal members being inverted with respect to the tops and bottoms.

14. The concrete form assembly of claim 13, further comprising a gusset disposed between each connecting leg and each bottom of each trapezoidal member.

15. The concrete form assembly of claim 12, further comprising each cylinder having an axial hole formed therein, an inverted U-shaped rod having a base with a desired length and two legs at right angles to the base, wherein one leg is received in the axial hole of a selected cylinder on the least one panel of the first wall and the other leg is received in the axial hole in another selected cylinder on the at least one panel of the second wall such that support is provided to maintain the spaced-apart walls.

16. The concrete assembly of claim 12 further comprising each cylinder having a slot formed therein opposite from the stud, a plurality of straight wire metal rods, one of the straight rods being disposed in the respective slots of each of a selected number of cylinders in the first wall and in the opposite second wall such that the first wall is connected to the second wall by the plurality of straight rods.

17. The concrete assembly of claim 16, wherein a protrusion is formed in the slot in each cylinder to retain the rod within the slot in the respective cylinder.

18. The concrete form assembly of claim 12, wherein the panels forming the first wall and the second wall are each formed from respective upper panels interconnected with respective lower panels, the selected number of bridges connecting the panels in the first wall to the panels in the second wall, means for connecting the bridges between the upper panels to the bridges between the lower panels to provide increased strength and stability to the walls.

19. The concrete form assembly of claim 18, further comprising each bridge having an upper surface having at least one notch therein, a hold-down clip, the hold-down clip having a hooked first end and an opposite hooked second end, wherein the hooked first end of the hold-down clip is received in the at least one notch in a first selected bridge connected to a selected panel and the hooked second end of the hold-down clip is received in the at least one notch in a second selected bridge connected to a panel vertically disposed with respect to the selected panel, the second selected bridge being under the first selected bridge and being disposed in an inverted position with respect to the first selected bridge, wherein increased strength and stability is provided to the joined vertically disposed panels.

20. The concrete form assembly of claim 12, further comprising each bridge having a body having a lowermost portion connecting the cylinders at the opposite ends of the bridge, the lowermost portion having an inverted triangular shape such that concrete may flow in a uniform manner around the bridge to reduce cavities.

21. The concrete form assembly of claim 12, wherein each panel has a tongue formed on the top and a groove formed on the bottom, the tongue having a straight side and an opposite side having a plurality of adjoining semi-circles, and the groove having a straight side and an opposite side having a plurality of semicircles such that the tongues and grooves of vertically oriented panels cooperate to interlock the vertically oriented panels.

22. In a concrete form assembly for construction of a structure having at least two rectangular insulation panels, each panel having an inner face, the respective inner faces being opposed to one another, the improvement comprising:

the inner face of each panel having a plurality of spaced-apart cylinders extending outwardly therefrom, each cylinder having a n axial hole formed therein, an inverted U-shaped rod having a base with a desired length and two legs at right angles to the base, wherein one leg is received in the axial hole in a selected cylinder on one of the panels and the other leg is received in the axial hole in a selected cylinder on the opposite panel, thereby separating the panels and providing support to the assembly.

23. The concrete form assembly of claim 22, wherein the inverted U-shaped rod is disposed approximately perpendicularly between the opposed panels.

24. The concrete form assembly of claim 22, wherein the inverted U-shaped rod is disposed at an acute angle with respect to the one of the panels and at a complementary obtuse angle with respect to the opposite panel.

25. In a concrete form assembly for construction of a structure having a plurality of rectangular insulation panels, each panel having an inner face, a top and a bottom, means for interlocking the tops and bottoms of at least two panels wherein at least one upper panel is disposed over at least one lower panel, to form respectively a first wall and an opposite second wall, the improvement comprising:

a plurality of connecting means being formed in the inner faces of each panel, a plurality of bridges, each having a first end and an opposite second end, means for connecting the first end of each bridge to a selected connecting means on a selected panel in the first wall and means for connecting the second end of each bridge to an opposite selected panel in the second wall wherein a plurality of upper bridges are disposed between the respective upper panels and a plurality of lower bridges are disposed between the respective lower panels in the first wall and the second wall, means for connecting the upper bridges with the lower bridges to increase the strength of the concrete form assembly.

26. The improvement of claim 25, further comprising:

each bridge having an upper surface having at least one notch therein, a hold-down clip, the hold-down clip having a hooked first end and an opposite hooked second end, wherein the hooked first end of the hold-down clip is received in the at least one notch in a first selected bridge connecting to a selected panel and the hooked second end of the hold-down clip is received in the at least one notch in a second selected bridge connected to a panel vertically disposed with respect to the selected panel, the second selected bridge being under the first selected bridge and being disposed in an inverted position with respect to the first selected bridge, wherein increased strength and stability is provided to the joined vertically disposed panels.

27. In a building structure, wherein a pair of spaced-apart panels form a mold for pouring a concrete wall therebetween, and wherein the panels have respective studs embedded therein, the studs having respective inwardly-disposed projections, the improvement comprising wire rod bridges having a snap-fit connection to respective pairs of inwardly-disposed projections on the studs, thereby connecting the studs together, and thereby maintaining the panels in their spaced-apart disposition during the pouring of the concrete.

28. The improvement of claim 27, wherein the inwardly-disposed projections on the studs are provided with vertically-disposed respective bores, and wherein each wire rod bridge is provided with a pair of right-angularly bent legs, such that the respective legs of a bridge are received within the respective bores of a pair of projections on the studs.

29. The improvement of claim 28, wherein the wire rod bridges are disposed perpendicularly of the panels.

30. The improvement of claim 29, wherein additional wire rod bridges are disposed at an angle to the panels.

31. In a building structure, wherein a pair of spaced-apart panels form a mold for the pouring of concrete therebetween, and wherein a plurality of respective pairs of spaced-apart panels are arranged horizontally and vertically with respect to each other to form a wall, the improvement comprising a plurality of wire rod bridges cooperating with respective pairs of inwardly-projecting studs embedded in the panels, thereby maintaining the panels in their spaced-apart disposition during the pouring of the concrete, and a plurality of hold-down clips connecting at least some of the wire rod bridges on respective adjacent pairs of panels, thereby keeping the adjacent pairs of panels together for improved stability in the subsequent pouring of the concrete, and such that the wire rod bridges and the hold-down clips provide a reinforcement in the concrete for increased wall strength.

32. The improvement of claim 31, wherein the adjacent pairs of panels are disposed horizontally with respect to each other.

33. The improvement of claim 32, wherein the adjacent pairs of panels are disposed vertically with respect to each other.

34. A method of preparing a form assembly for construction of a concrete wall comprising the steps of:

providing at least a pair of spaced-apart opposed panels, each panel having a plurality of spaced-apart studs embedded therein, each stud having a plurality of inwardly-disposed projections, each projection having a snap-fit connection formed thereon, providing a plurality of wire rod bridges, each bridge having opposite ends, disposing the wire rod bridges between the opposed panels, the respective ends of each bridge being connected to a respective snap-fit connection on a respective projection, wherein the opposite panels are maintained in the spaced-apart disposition and the wire rods provide reinforcement for the concrete.

35. A method of preparing a form assembly for construction of a structure comprising the steps of:

providing at least two rectangular insulation panels, each having a top, a bottom, two opposite sides and an inner face, interlocking a plurality of panels on their respective tops, bottoms and sides and forming a first wall and an opposite second wall, encasing a plurality of studs in each panel between the respective tops and bottoms, each stud having a first end and an opposite second end, a plurality of spaced-apart cylinders being formed on each stud between the first end and the second end thereof, each cylinder having an axial hole formed therein, wherein the cylinders extend outwardly from the respective inner faces of the panels, providing plurality of bridges, each bridge having a length, a first end and a second end, a collar being formed respectively on the first end and the second end of each bridge, each collar being a hollow cylinder, disposing a selected number of bridges between the first panel and the second panel such that selected cylinders on the respective panels are frictionally seated in the collars on the bridges to connect the inner face of the first panel with the inner face of the second panel, the panels being spaced apart by a distance determined by the length of the bridge.

36. The method of claim 35, further comprising the steps of:

providing an inverted U-shaped rod having a base with a desired length and two legs at right angles to the base, disposing one leg in the axial hole in a selected cylinder on one panel and disposing the other leg in the axial hole in a selected cylinder on the other panel such that the panels are supported and spaced apart at a distance determined by the length of the base.

37. The method of claim 35, wherein each bridge has an upper surface on which there is formed at least one notch, providing a hold-down clip having a hooked first end and a hooked opposite second end, engaging the first hooked end in the at least one notch in a first selected bridge connected to a selected panel and engaging the lower hook end in the at least one notch in a second selected bridge connected to a panel vertically disposed with respect to the selected panel, the second selected bridge being located under the first selected bridge and disposed in an inverted position with respect to the first selected bridge such that increased strength and stability is provided to the joined vertically disposed panels by the hold-down clip.

38. The method of claim 35, wherein each stud is formed from a plurality of trapezoidal members.

39. In a building structure, wherein a pair of spaced-apart molded panels facilitate the pouring of concrete therebetween, and wherein respective inwardly-protruding portions of molded-in studs in each of the panels are connected together by a molded bridge, thereby retaining the panels in their spaced-apart disposition prior to the pouring of the concrete, the improvement comprising a first molded bridge that may be connected to the inwardly-protruding portions of the molded-in studs, a second wire rod bridge having respective end portions that may be connected to the protruding portions of the molded-in studs after the first molded bridge is in place on the studs, wherein the respective end portions of the second wire rod bridge may be connected directly to the protruding portions of the molded-in studs without the presence of the first molded bridge, such that just the first molded bridge may be used, or just the second wire rod bridge may be used, or both may be used depending upon the desired strength of the building structure consonant with cost parameters, thereby providing the architect, building engineer, contractor, developer and/or property owner a desired high degree of flexibility in the design and construction of the building structure.

40. The improvement of claim 39, wherein the second wire rod bridge may be used perpendicularly to the spaced-apart molded panels or at an angle thereto.

* * * * *